US005890631A

United States Patent [19]

Spurlock et al.

[11] Patent Number: 5,890,631

[45] Date of Patent: Apr. 6, 1999

[54] AEROSOL CAP WITH DISPENSING TUBE SUPPORT SYSTEM

[76] Inventors: Reginald F. Spurlock, P.O. Box 12, Squires, Mo. 65755; Harold E. Kellogg, 7311 McKamy Blvd., Dallas, Tex. 75248

[21] Appl. No.: 791,661

[22] Filed: Jan. 30, 1997

[51] Int. Cl.[6] ..... B67D 3/00

[52] U.S. Cl. ..... 222/538; 222/182; 222/526; 222/527; 222/530

[58] Field of Search ..... 222/526, 527, 222/530, 538, 182, 402.13; 239/333, 587.1, 588

[56] References Cited

U.S. PATENT DOCUMENTS

| | | | |
|---|---|---|---|
| 3,881,638 | 5/1975 | Grothoff | 222/182 |
| 4,096,974 | 6/1978 | Haber et al. | 222/530 |
| 4,305,528 | 12/1981 | Craig | 222/182 |
| 4,664,300 | 5/1987 | Strickland | 222/530 |
| 5,154,323 | 10/1992 | Query et al. | 239/588 |

*Primary Examiner*—David J. Walczak
*Assistant Examiner*—Timothy L. Maust

[57] ABSTRACT

A new Aerosol Cap With Dispensing Tube Support System for maintaining the position of a dispensing tube in relation to a spray nozzle of an aerosol can during use and storage. The inventive device includes a cylindrical cap having an arcuate cutout, a lid removably attached to the cap, an aperture projecting toward a longitudinal axis of the cap, and a dispensing tube having a cincture removably projecting through the aperture to engage a spray nozzle. The cylindrical cap removably secured to a rim of an aerosol can and around the spray nozzle. The arcuate cutout is for allowing easy access to the spray nozzle during utilization. The dispensing tube is snugly supported within the aperture projecting through the cap thereby reducing the chance of the dispensing tube becoming dislodged from the spray nozzle.

11 Claims, 3 Drawing Sheets

FIG. 5
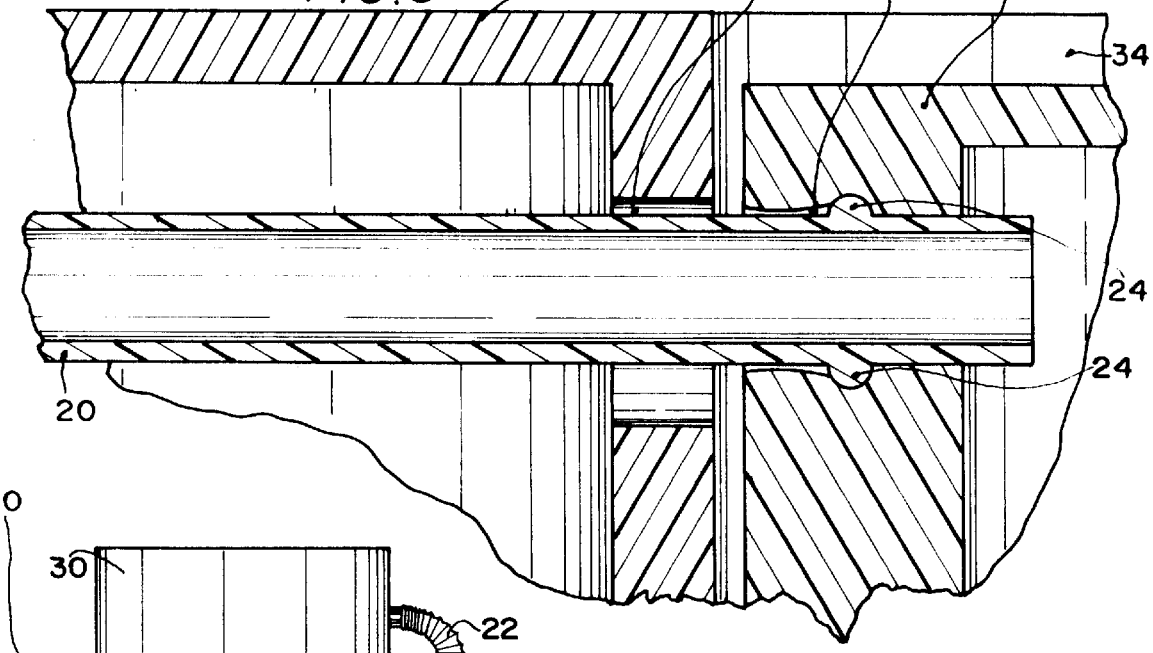
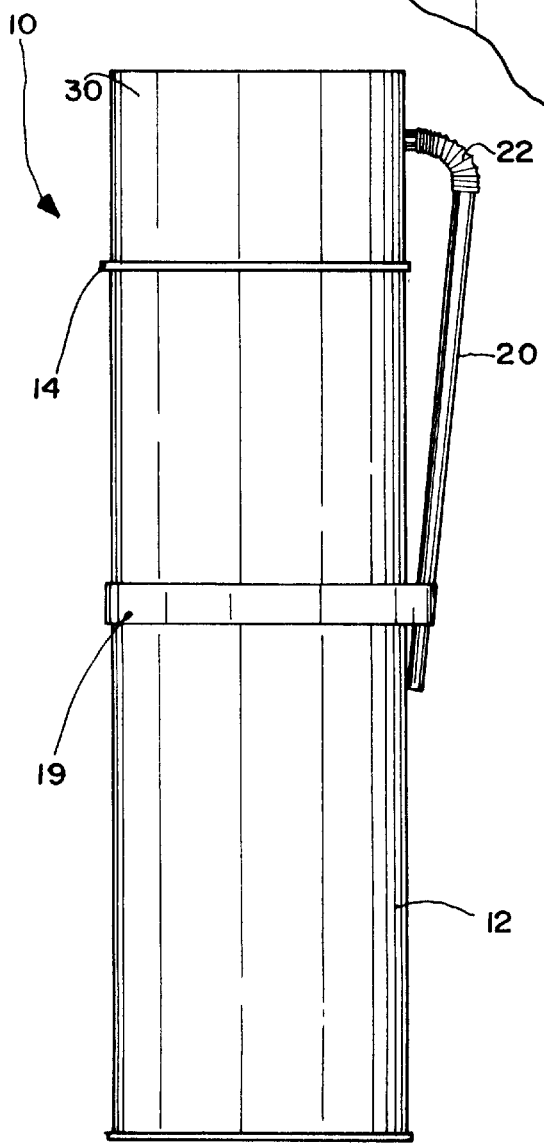
FIG. 6

AEROSOL CAP WITH DISPENSING TUBE SUPPORT SYSTEM

BACKGROUND OF THE INVENTION

1. Field of the Invention

The present invention relates to Spray Cap Devices and more particularly pertains to a new Aerosol Cap With Dispensing Tube Support System for maintaining the position of a dispensing tube in relation to a spray nozzle of an aerosol can during use and storage.

2. Description of the Prior Art

The use of Spray Cap Devices is known in the prior art. More specifically, Spray Cap Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Spray Cap Devices include U.S. Pat. No. 4,520,951; U.S. Pat. No. 5,058,783; U.S. Pat. No. 5,411,187; U.S. Pat. No. 5,143,263; U.S. Pat. No. 4,858,792 and U.S. Pat. No. 4,819,838.

While these devices fulfill their respective, particular objectives and requirements, the aforementioned patents do not disclose a new Aerosol Cap With Dispensing Tube Support System. The inventive device includes a cylindrical cap having an arcuate cutout, a lid removably attached to the cap, an aperture projecting toward a longitudinal axis of the cap, and a dispensing tube having a cincture removably projecting through the aperture to engage a spray nozzle.

In these respects, the Aerosol Cap With Dispensing Tube Support System according to the present invention substantially departs from the conventional concepts and designs of the prior art, and in so doing provides an apparatus primarily developed for the purpose of maintaining the position of a dispensing tube in relation to a spray nozzle of an aerosol can during use and storage.

SUMMARY OF THE INVENTION

In view of the foregoing disadvantages inherent in the known types of Spray Cap Devices now present in the prior art, the present invention provides a new Aerosol Cap With Dispensing Tube Support System construction wherein the same can be utilized for maintaining the position of a dispensing tube in relation to a spray nozzle of an aerosol can during use and storage.

The general purpose of the present invention, which will be described subsequently in greater detail, is to provide a new Aerosol Cap With Dispensing Tube Support System apparatus and method which has many of the advantages of the Spray Cap Devices mentioned heretofore and many novel features that result in a new Aerosol Cap With Dispensing Tube Support System which is not anticipated, rendered obvious, suggested, or even implied by any of the prior art Spray Cap Devices, either alone or in any combination thereof.

To attain this, the present invention generally comprises a cylindrical cap having an arcuate cutout, a lid removably attached to the cap, an aperture projecting toward a longitudinal axis of the cap, and a dispensing tube having a cincture removably projecting through the aperture to engage a spray nozzle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Aerosol Cap With Dispensing Tube Support System apparatus and method which has many of the advantages of the Spray Cap Devices mentioned heretofore and many novel features that result in a new Aerosol Cap With Dispensing Tube Support System which is not anticipated, rendered obvious, suggested, or even implied by any of the prior art Spray Cap Devices, either alone or in any combination thereof.

It is another object of the present invention to provide a new Aerosol Cap With Dispensing Tube Support System which may be easily and efficiently manufactured and marketed.

It is a further object of the present invention to provide a new Aerosol Cap With Dispensing Tube Support System which is of a durable and reliable construction.

An even further object of the present invention is to provide a new Aerosol Cap With Dispensing Tube Support System which is susceptible of a low cost of manufacture with regard to both materials and labor, and which accordingly is then susceptible of low prices of sale to the consuming public, thereby making such Aerosol Cap With Dispensing Tube Support System economically available to the buying public.

Still yet another object of the present invention is to provide a new Aerosol Cap With Dispensing Tube Support System which provides in the apparatuses and methods of the prior art some of the advantages thereof, while simultaneously overcoming some of the disadvantages normally associated therewith.

Still another object of the present invention is to provide a new Aerosol Cap With Dispensing Tube Support System for maintaining the position of a dispensing tube in relation to a spray nozzle of an aerosol can during use and storage.

Yet another object of the present invention is to provide a new Aerosol Cap With Dispensing Tube Support System which includes a cylindrical cap having an arcuate cutout, a lid removably attached to the cap, an aperture projecting toward a longitudinal axis of the cap, and a dispensing tube having a cincture removably projecting through the aperture to engage a spray nozzle.

Still yet another object of the present invention is to provide a new Aerosol Cap With Dispensing Tube Support System that increases productivity and the quality of workmanship.

Even still another object of the present invention is to provide a new Aerosol Cap With Dispensing Tube Support System that stabilizes the dispensing tube with respect to the spray nozzle.

These together with other objects of the invention, along with the various features of novelty which characterize the invention, arc pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view taken along line 5—5 of FIG. 4.

FIG. 6 is a side view of the present invention attached to an aerosol can.

DESCRIPTION OF THE PREFERRED EMBODIMENT

Figure 1:
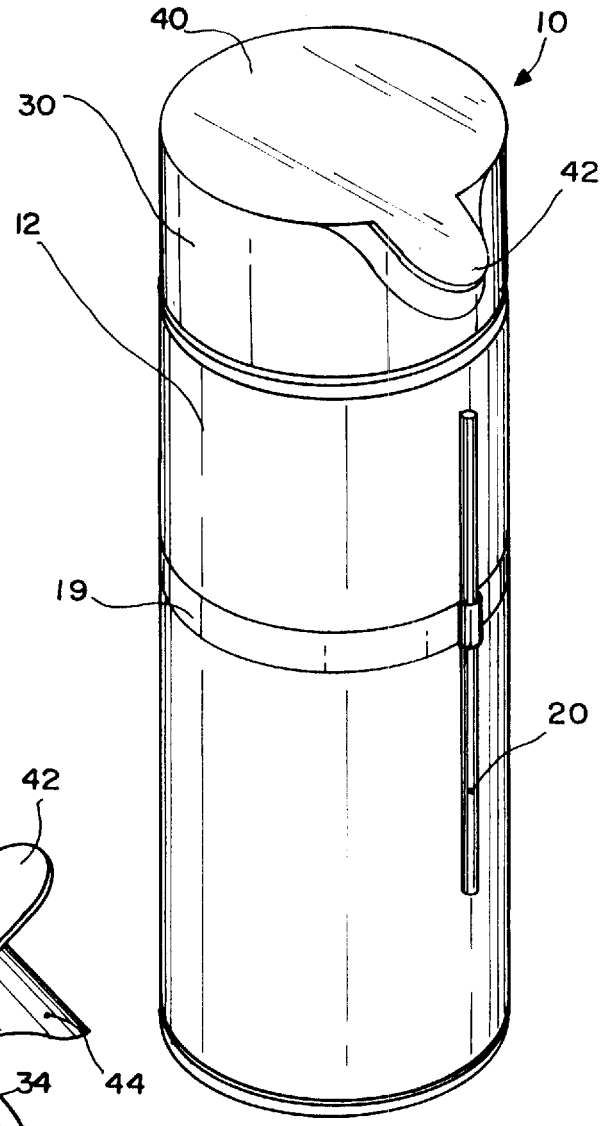
FIG. 1 is an upper perspective view of a new Aerosol Cap With Dispensing Tube Support System attached to an aerosol can according to the present invention.

With reference now to the drawings, and in particular to FIGS. 1 through 6 thereof, a new Aerosol Cap With Dispensing Tube Support System embodying the principles and concepts of the present invention and generally designated by the reference numeral 10 will be described.

Figure 2:
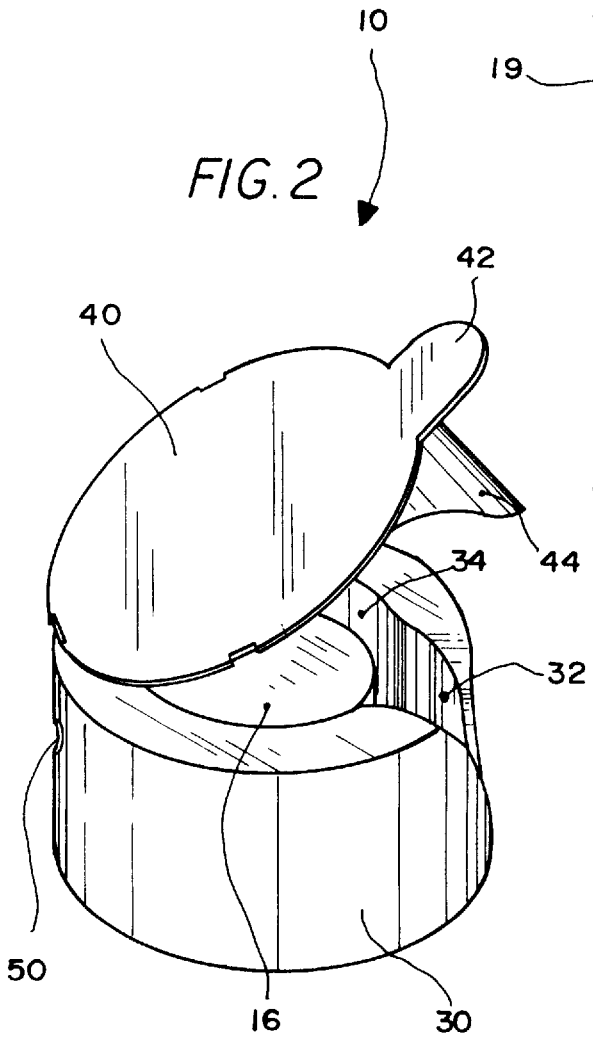
FIG. 2 is a magnified upper perspective view of the present invention.
Figure 3:
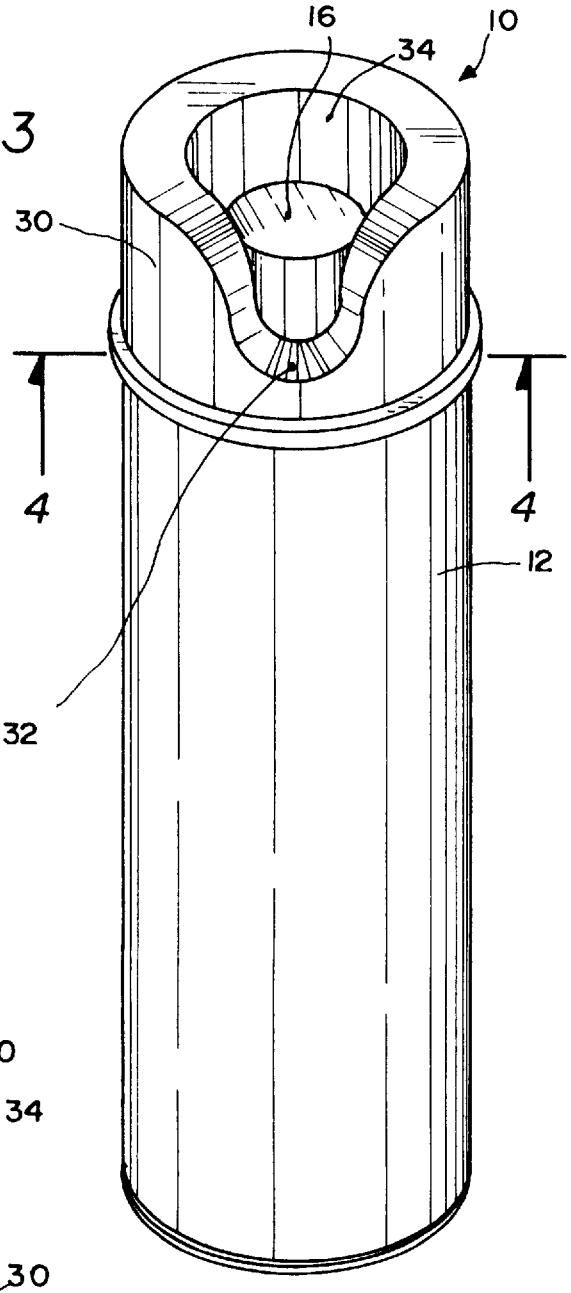
FIG. 3 is an upper perspective view of the present invention attached to an aerosol can.
Figure 4:
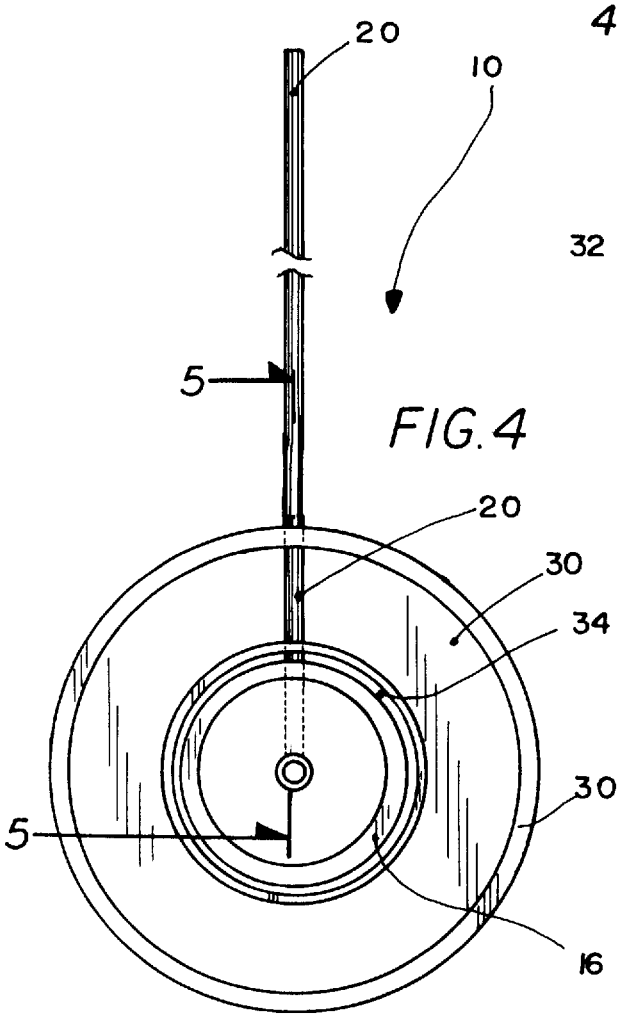
FIG. 4 is a cross sectional view taken along line 4—4 of FIG. 3.

More specifically, it will be noted that the Aerosol Cap With Dispensing Tube Support System 10 comprises a cylindrical cap 30 having a passage 34 along a longitudinal axis of the cylindrical cap 30. The cylindrical cap 30 removably attaches to a rim 14 of an aerosol can 12 and the passage 34 surrounds a spray nozzle 16 of the aerosol can 12 as best shown in FIGS. 3 and 4 of the drawings. The cylindrical cap 30 preferably includes an arcuate cutout 32 projecting downwardly opposite of the aperture 50 for allowing a user to easily insert a finger for engaging the spray nozzle 16 as best shown in FIGS. 2 and 3 of the drawings. An aperture 50 projects through the cylindrical cap 30 projects radially from within the passage 34 to an exterior portion of the cylindrical cap 30 substantially traverse to the longitudinal axis as shown in FIG. 5 of the drawings.

A dispensing tube 20 snugly projects through the aperture 50 and engages at one end an outlet port 18 within the spray nozzle 16 for dispensing fluid from within the aerosol can 12 as shown in FIG. 5 of the drawings. The aperture 50 prevents the dispensing tube 20 from becoming dislodged from the outlet port 18 during utilization or storage. The dispensing tube 20 includes a cincture 24 near the end engaging the outlet port 18 of the spray nozzle 16 for preventing the removal of the dispensing tube 20 from within the outlet port 18 during utilization and storage as best shown in FIG. 5 of the drawings. The dispensing tube 20 preferably includes a flexible elbow 22 near the end engaging the spray nozzle 16 outside of the cylindrical cap 30 for allowing selective directional spraying of fluid within the aerosol can 12 as shown in FIG. 6 of the drawings.

As shown in FIGS. 1 and 2 of the drawings, a lid 40 is preferably removably secured to the cylindrical cap 30 for enclosing an end of the passage 34 opposite of the aerosol can 12. The lid 40 includes a tab 42 for allowing simple removal of the lid 40 from the cylindrical cap 30 as best shown in FIGS. 1 and 2 of the drawings. The lid 40 includes a tongue 44 secured substantially orthogonally to the lid 40 projecting downwardly for enclosing the arcuate cutout 32.

In use, the dispensing tube 20 is snugly positioned within the aperture 50 where the dispensing tube 20 engages the outlet port 18 of the spray nozzle 16. The user thereafter removes the lid 40 by grasping the tab 42. The spray nozzle 16 thereafter is depressed allowing the contents of the aerosol can 12 to flow through the outlet port 18 into the dispensing tube 20. The contents thereafter flow outwardly from the dispensing tube 20 towards the intended object to be sprayed. The user may also manipulate the flexible elbow 22 to achieve the optimum performance of the spray. When finished with the present invention, the user simply bends the flexible elbow 22 so that the dispensing tube 20 is substantially parallel to the aerosol can 12 where the end opposite of the cincture 24 may be secured by a length of tape 19 secured to the aerosol can 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An aerosol cap with dispensing tube support system comprising:

a cylindrical cap having a passage along a longitudinal axis of said cylindrical cap, wherein said cylindrical cap removably attaches to a rim of an aerosol can and said passage surrounds a spray nozzle of said aerosol can, said spray nozzle including an outlet port therein;

a lid removably resecured to said cylindrical cap for enclosing and end of said passage opposite of said aerosol can;

an enclosed duct projecting through said cylindrical cap and extending radially outward from said passage to provide an opening in an exterior surface of said cylindrical cap oriented substantially transverse to said longitudinal axis; and a dispensing tube engaging the outlet port in said spray nozzles;

wherein the duct snugly engages a portion of the dispensing tube for resisting dislodgement of said dispensing tube from said outlet port.

2. The aerosol cap with dispensing tube support system of claim 1, wherein said cylindrical cap includes an arcuate cutout projecting downwardly at a location substantially opposite of said duct for allowing a user to easily insert a finger into said passage for engaging said spray nozzle.

3. The aerosol cap with dispensing tube support system of claim 1, wherein said lid includes a tab for facilitating finger liftable removal of said lid from said cylindrical cap.

4. The aerosol cap with dispensing tube support system of claim 1, wherein said lid includes a tongue secured substantially orthogonally to said lid and having a shape adapted for closing said arcuate cutout when said lid is secured to said cap, and wherein said lid includes a tab located adjacent to said tongue for facilitating finger liftable removal of said lid from said cylindrical cap.

5. An aerosol cap with dispensing tube support system comprising:

a cylindrical cap having a passage along a longitudinal axis of said cylindrical cap, wherein said cylindrical cap removably attaches to a rim of an aerosol can and said passage surrounds a spray nozzle of said aerosol can, said spray nozzle including an outlet port therein;

a lid removably secured to said cylindrical cap for enclosing an end of said passage opposite of said aerosol can;

a generally cylindrical enclosed duct radially projecting through said cylindrical cap between said passage and an exterior surface of said cylindrical cap, the duct being positioned substantially transverse to said longitudinal axis; and a dispensing tube snugly extending through said duct, one end of said dispensing tube engaging the outlet port in said spray nozzle for dispensing fluid from within said aerosol can, wherein a portion of said dispensing tube is snugly engaged by an outer portion of said duct for resisting dislodgement of said dispensing tube from said outlet port.

6. The aerosol cap with dispensing tube support system of claim 5, wherein said cylindrical cap includes an arcuate cutout projecting downwardly opposite of said duct for allowing a user to easily insert a finger through the arcuate cutout for engaging said spray nozzle.

7. The aerosol cap with dispensing tube support system of claim 5, wherein said lid includes a tab for facilitating removal of said lid from said cylindrical cap.

8. The aerosol cap with dispensing tube support system of claim 7, wherein said lid includes a tongue secured substantially orthogonally to said lid for enclosing said arcuate cutout.

9. The aerosol cap with dispensing tube support system of claim 8, wherein said dispensing tube includes an annular rib extending about the circumference of the dispensing tube and located near said end of said tube for engaging a groove in said outlet port of said spray nozzle for resisting the removal of said dispensing tube from said outlet port.

10. The aerosol cap with dispensing tube support system of claim 8, wherein said dispensing tube includes an integral flexible elbow positioned outside of said cylindrical cap for allowing selective directional spraying of fluid within said aerosol can.

11. An aerosol cap with dispensing tube support system comprising:

a cylindrical cap having an annular outer member surrounding a passage along a longitudinal axis of said cylindrical cap, said outer member including an upper wall, an inner wall, an outer wall, and an interior space, wherein said outer wall includes a lip for removably attaching the cylindrical cap to a rim of an aerosol can such that said passage surrounds a spray nozzle of said aerosol can;

a generally circular enclosed first duct radially projecting through said outer wall of said cylindrical cap, a second duct projecting radially through said inner wall of said cylindrical cap, the first duct and the second duct being positioned substantially transverse to said longitudinal axis; and a dispensing tube snugly projecting through said first duct and said second duct, one end of said dispensing tube engaging an outlet port in said spray nozzle for dispensing fluid from within said aerosol can when said nozzle is depressed, wherein a portion of said dispensing tube is snugly engaged by said first duct for preventing said dispensing tube from becoming dislodged from said outlet port during utilization or storage;

wherein the second duct is larger than the first duct for permitting vertical movement of said dispensing tube inside said second duct when said nozzle is depressed;

wherein said cylindrical cap includes an arcuate cutout projecting downwardly opposite of said duct for allowing a user to easily insert a finger through the arcuate cutout for engaging said spray nozzle;

a lid removably secured to said cylindrical cap for enclosing an end of said passage opposite of said aerosol can;

wherein said lid includes a tab for facilitating removal of said lid from said cylindrical cap;

wherein said lid includes a tongue secured substantially orthogonally to said lid for enclosing said arcuate cutout;

wherein said dispensing tube includes a cincture near said end for engaging a groove in said outlet port of said spray nozzle for preventing the removal of said dispensing tube from within said outlet port during utilization and storage; and wherein said dispensing tube includes an integral flexible elbow positioned outside of said cylindrical cap for allowing selective directional spraying of fluid within said aerosol can.

* * * * *